United States Patent [19]

Nishio et al.

[11] 4,393,324

[45] Jul. 12, 1983

[54] SPARK PLUG WITH A SPHERE-LIKE METAL CENTER ELECTRODE AND MANUFACTURING PROCESS THEREOF

[75] Inventors: Kanemitsu Nishio, Komaki; Shunichi Takagi, Tajimi; Yasuhiko Suzuki, Nagoya, all of Japan

[73] Assignee: NGK Spark Plug Co., Nagoya, Japan

[21] Appl. No.: 185,956

[22] Filed: Sep. 10, 1980

[30] Foreign Application Priority Data

Sep. 14, 1979 [JP] Japan ..... 54-118046

[51] Int. Cl.[3] ..... H01T 13/20; H01T 13/32

[52] U.S. Cl. ..... 313/133; 313/136; 313/141; 445/7

[58] Field of Search ..... 313/141, 133, 142, 136; 29/25.12

[56] References Cited

U.S. PATENT DOCUMENTS

| | | | |
|---|---|---|---|
| 2,265,352 | 12/1941 | Corbin et al. | 313/136 |
| 2,296,045 | 9/1942 | McDougal et al. | 313/136 X |
| 2,505,150 | 4/1950 | Schwartzwalder et al. | 313/124 X |
| 3,235,655 | 2/1966 | Counts et al. | 313/136 X |
| 3,349,275 | 10/1967 | Blum et al. | 313/124 X |
| 3,567,658 | 3/1971 | Webb et al. | 313/136 X |
| 4,001,145 | 1/1977 | Sakai et al. | 252/513 |
| 4,006,106 | 2/1977 | Yoshida et al. | 252/513 |

*Primary Examiner*—Palmer C. Demeo

*Attorney, Agent, or Firm*—Segner & Bretschneider

[57] ABSTRACT

A spark plug with a sphere-like center discharge electrode is obtained by pressing a sphere-like metal essentially consisting of noble metal Au, Ag and/or alloys thereof with Pd or the like set on a small end bore formed at a discharge end bottom of a ceramic insulator. Sealing of a sealing material and/or resistor material together with setting (sealing) of a terminal body may be done simultaneously with the pressing of the sphere-like metal on the small end bore by means of hot-pressing applied on the terminal rod head.

25 Claims, 6 Drawing Figures

SPARK PLUG WITH A SPHERE-LIKE METAL CENTER ELECTRODE AND MANUFACTURING PROCESS THEREOF

BACKGROUND

The present invention relates to a spark plug having a novel center discharge electrode and a manufacturing process thereof.

In the prior art, a general conventional construction of the spark plug comprises a refractory insulator with the center bore, a terminal rod and a center discharge rod electrode, the latter two being inserted in the center bore of the refractory insulator and being electorically conductively sealed with a conductive sealing glass composition therein, and, if desired, a resistor material is incorporated in the center bore between the terminal rod and the center electrode.

A conventional type of the metallic center discharge electrode (center electrode hereinafter) is formed of a nickel or nickel alloy rod or such rod with a copper core. For those spark plugs, a high dimensional accuracy for each parts, particularly that for an inner diameter of a discharge end portion of a refractory insulator (insulator hereinafter) and for an outer diameter of the center electrode is required. Furthermore, a sealing process for these parts should be controlled in a highest accuracy in respect with sealing and impact resistance properties of such products. Those are marked as drawbacks of this type of the spark plug.

One type of center electrode has a welded noble metal tip at its discharge end which renders an improved durable life, whreras it requires an additional step of welding and a larger amount of discharge tip metal is consumed more than actually necessary for discharge purpose per se although merely a minor amount thereof functions as such in the practice. The discharge tip is usually welded to the head portion with an enlarged diameter of a base electrode rod formed in a rivet like (T type cross-section) form, which is necessary for preventing the discharge electrode from dropping off in order to mechanically form-lockingly secure it to a discharge end bore of the insulator, because a detriment in bonding strength of welded portion during an application under a high temperature would otherwise be caused. Those facts make this type also accompanied by a higher cost of manufacture.

SUMMARY OF THE INVENTION

Accordingly, it is an object of the present invention to provide a novel spark plug which can eliminate the drawbacks in the prior art as hereinabove mentioned.

It is a further object of the present invention to provide a spark plug which requires only a small amount of discharge tip noble metal such as Au, Ag, Au—Ag alloy, or alloys thereof with Pd.

Still a further object of the present invention is to provide a spark plug and a manufacturing process thereof which allows to reduce or significantly eliminate steps and/or control steps therefor of a precise center bore working, welding of the tip and securing a precise dimentional accuracy of each pertinent parts.

Further objects of the invention will become apparent in the following description thereof.

The present invention provides a spark plug omprising a refractory insulator with a center bore having a bottom end provided with a small end bore and a discharge center electrode fixed to said small end bore by means of pressing a sphere-like metal having a higher melting point than a sealing temperature of a conductive sealing glass composition on and in said small bore. The present invention provides further such a spark plug as hereinabove mentioned and further comprises a small end bore which is tapered with an increasing diameter towards the inside of said center bore.

The invention provides also a process for manufacturing a spark plug which comprises a step of forming a small end bore at a bottom end of a refractory insulator with a center bore, and a step of hot-pressing a sphere-like metal having a higher melting point than a sealing temperature of a conductive sealing glass composition on and in the small end bore outwardly from the center bore inside thereby forming and making a discharge center electrode adhered to the small end bore.

Furthermore, the invention provides a process for manufacturing a spark plug which comprises following steps a–e:

a. a step of forming a small end bore at a bottom end of a refractory insulator with a center bore,
b. a step of setting a sphere-like metal on the small end bore in the center bore bottom,
c. a step of charging the center bore with a sealable conductive powder material upon said sphere-like metal,
d. a step of heating the charged mass and the metal, and
e. a step of hot-pressing the charged mass and the metal thereby to seal the charged mass and to form a discharge center electrode.

Optionally, the center bore may be charged additionally to the step c with a powdery resistor material.

The present invention is further described with reference to drawings which illustrate preferred embodiments of the invention.

BRIEF DESCRIPTION OF THE DRAWINGS

The present invention is illustrated in drawings for better illustration and understanding thereof and not for limitation thereof, a modification may be made without departing from the spirit and scope of the present invention.

In the drawings shows each figure as follows.

DETAILED DESCRIPTION OF THE INVENTION

Figure 1:
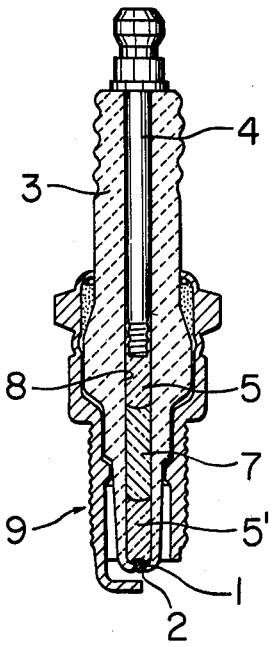
FIG. 1 shows a longitudinal cross-section of an embodiment of the invention.
Figure 2:
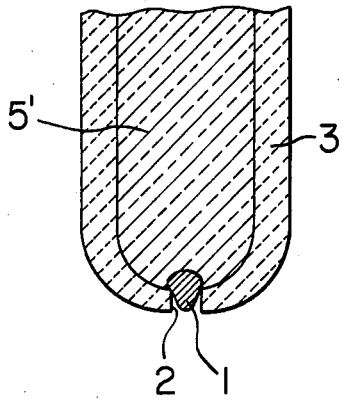
FIG. 2 shows an enlarged view of a center electrode portion of FIG. 1, FIGS. 3–6 show further embodiments of center electrodes and small end bore portions, respectively.
Figure 3:
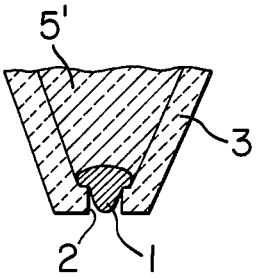
Figure 4:
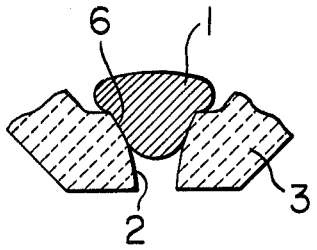
Figure 5:
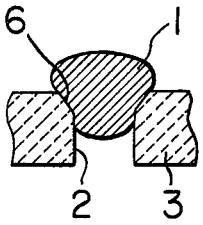
Figure 6:
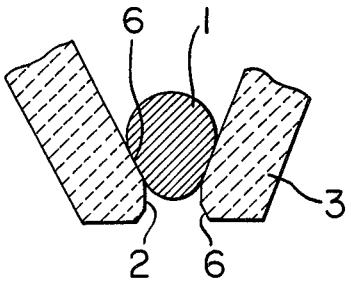

In the present invention, a center discharge electrode 1 (center electrode) is composed of a metallic electrode which is formed by way of a plastic-deformation from a sphere-like metal, i.e., pressurizedly deformed in a small end bore 2 of a hollow insulator 3 with a center bore 8 almost extending to an outer end of the small end bore 2 under a pressure application outwardly from the inside of the center bore, thus tightly adhered to an inner wall of the small end bore. The sphere-like metal before the deformation is sphere-like which term encompasses also spheroidal and similar polyhedral form or the like, preferably approximately spherical. The center elctrode 1 can be formed in a desired form which corresponds to or depends upon a cross-section of the small end bore 2. The small end bore 2 may be formed in a cylindrical bore, tapered or beveled bore, bore of a circular or other polygonal cross-section, preferably of a circular cross-section. This small end bore 2 can be partly or over a whole length tapered, and preferably be tapered at least at one portion with an increasing diameter towards the center bore side. Namely, the form or cross-section of the small end bore 2 is so defined as suitable for a spark plug discharge end, and the small end bore 2 is beforehand prepared correspondingly thereto, whereafter a center electrode 1 is pressed on and/or in the predetermined small end bore 2 to form a corresponding cross-section. For reducing electrode metal consumption, the cross-section of the small end bore is defined in a smallest diameter if necessary, while the depth or length thereof (i.e. thickness of the insulator bottom end) is so defined as to permit a suitable strength of the insulator and dielectric strength. A preferred diameter of the small end bore ranges approximately 0.5–2.0 mm and a preferred depth thereof is approximately 0.5–2.5 mm usually.

The sphere-like metal for the center electrode 1 essentially consists of one selected from the group consisting of Au, Ag, Au—Ag alloy, alloys of each foregoing metal with Pd, Ni, Cr or Ni—Cr, alloys of each of Au—Pd, Ag—Pd, Au—Ag—Pd with Ni, Cr, or Ni—Cr, and Ag—Pt alloy. Preferred are following metal or alloys; Ag, Au, Ag—Au, Ag—Pd, Ag—Au—Pd, Ag—Cr, Ag—Au—Cr, Ag—Pd—Cr, Au—Pd, Au—Cr, Au—Pd—Cr and Ag—Pt. Such metal encompasses, e.g., a Ag—Au alloy of 40–80% by weight (as hereinafter if not otherwise mentioned) of Ag and the balance of Au or an alloy additionally comprising 1–10% Pd or 1–5% Cr thereto, a Ag—Pd alloy of 70–95% Ag and the balance of Pd or an alloy further comprising 1–5% Cr, an alloy of 80–95% Ag and the balance of Pt, and an alloy of 50–95% Au and the balance of Pd or an alloy further comprising 1–5% Cr.

The melting point of the sphere-like metal is not less than a sealing temperature of the sealable conductive powder material, e.g., a conductive sealing glass composition and/or a powdery mixture of metal, glass and refractory material. Preferably, such metal has a softening temperature within the sealing temperature range of the sealable conductive powder material, however, a higher softening temperature for such metal is not excluded in this embodiment of the spark plug, generally.

Such sphere-like metal has a melting point usually ranging 950°–1200° C., however such a metal as having a higher range of 1200°–1500° C. is also employed. For the latter, the hot-pressing of the metal is usually carried out beforehand prior to the sealing of the mass to be charged in the center bore, whereas the former metal also permits a simultaneous hot-pressing with the charge mass for the center electrode formation.

A preferred embodiment of a process for manufacturing the spark plug of the invention is now disclosed hereinbelow. In this embodiment, the sphere-like metal is hot-pressed after charging a sealable conductive powder material and, if desired, additionally a powdery resistor material and respective precompactions (if desired, these materials may be superposed again) and simultaneously with a sealing procedure thereof, whereby the sphere-like metal is pressed in a hot-pressing state on and in the small end bore 2 resulting in a discharge center electrode with a sphere-like, e.g., mostly spherical or spheroidal discharge end. The pressure application is usually made by means of a terminal rod 4 forcively inserted in the center bore 8 upon the charged mass by applying a downward pressure on a terminal rod head.

The sphere-like metal for this embodiment has a higher melting point than the sealing temperature of the charged mass in the center bore and allowable of plastic-deformation at the sealing temperature thereof. Practically, the sphere-like metal for this embodiment has a melting point approximately ranging 950°–1200° C., the lower and upper limits thereof being defined on the one hand in light of the sealing temperature range of the charged mass, e.g., that of conductive sealing glass composition since the melting point slightly higher than the sealing temperature will render a desired deformability of the sphere-like metal.

On the other hand, the lower limit of the melting point for such metal is defined by heat resistance requirements generally for the spark plug discharge center electrode which is subject to a high discharge and combustion temperature. Apart from this embodiment, such a metal as having a higher melting point up to 1500° C. is employed in the invention.

The sealable conductive powder material in this embodiment encompasses mainly a conductive sealing glass frit or a mixture thereof with a refractory powder, which can suitably be selected from such materials for spark plug use in generally. As a conductive sealing glass frit, a frit comprising 30–70% of metal powder as a conductive ingredient and the balance of a borosilicate glass frit is suitable for use, wherein the metal powder essentially consists of one or more selected from the group consisting of Cu, Ni, Fe, Fe—B, Ni—B, Cr, Ag, Co, Mo, W, Fe—Ti alloy, and alloys thereof. The metal powder preferably comprises not less than 10% by weight of FeB- and/or NiB-alloy. The refractory powder encompasses a mixture of alumina, zircon, zirconia and/or mullite, 5–20% by weight thereof being admixed to the conductive sealing glass composition as hereinabove mentioned.

The powdery resistor material is such a composition as employed for eliminating or reducing a radio wave interference or jamming, i.e., noise caused by a spark discharge of the spark plug, such spark plug being so-called a resistor-incorporated spark plug. This resistor material ranges, e.g. from a self-sealable one with a relative low resistance of 1–1.7 kΩ one of which is e.g., disclosed in U.S. Pat. No. 4,001,145 Sakai et al, the disclosure thereof being herein referred to, to one with a higher resistance of 3–7 kΩ (carbonaceous resistor, or one added with some aggregates such as clays or the like) when applied, i.e., sealed in a spark plug. These powdery masses are charged in the center bore 8 after the sphere-like metal was set on the end bore 2 at the center bore bottom then precompacted for a subsequent sealing (hot-pressing) procedure. The precompaction as above may be achieved by forcively inserting a terminal rod 4 in the center bore through the top opening thereof.

The sphere-like metal which is set on the inner end of the end bore 2 is simultaneously subjected to a high temperature during a heating procedure for sealing the charged mass, i.e. the conductive seal glass frit etc. This sphere-like metal stands in a softening state wherein the metal is plastic-deformable. Usually, the terminal rod 4 is inserted with its bottom end to a position slightly above than that for a resultant sealed or set position upon the insertion thereof, whereupon a pressure of about 20–50 kg/cm$^2$ is further applied enabling to hot-press the metal and charged powdery mass simultaneously. By this hot-pressing, the sphere-like metal is forced in and deformed in and on the small end bore 2 protruding therein tightly to be adhered to a small end bore wall. A head portion of the deformed metal remains in the center bore bottom with a larger diameter than the small end bore, whereby it may be secured in the center bore on an eventual disconnection of the metal from the small end bore wall.

If the sphere-like metal of Au, Ag, a Au—Ag alloy or a Au—Ag—Pd alloy is employed in this embodiment, the assembly is heated approximately to 800°-1200° C. after the charging and precompaction of the charged mass, then the terminal rod 4 inserted in the center bore is hot-pressed thereupon. The resultant high pressure at the hot-pressing of the terminal rod 4 simultaneously forces the suitably softened sphere-like metal into the small end bore 2, which procedure is a most preferred one in the present invention.

However, the sphere-like metal may beforehand be partly or completely pressed on the small end bore 2 by an pressure application prior to the terminal rod insertion, which is a modified embodiment of the first embodiment. In another second embodiment of the invention, it is further possible to press only the sphere-like metal before the powdery mass charging or after only a partial charging thereof, also to press it in the small end bore with or without pre-heating under a high pressure. Particularly, if some metal or alloy having a higher melting point of 1200°-1500° C. is used as a center electrode metal, the center electrode, e.g., made of a Au—Pd alloy (50% Au, 50% Pd by weight) is beforehand pressed in the small end bore at a temperature of about 1250° C. which stands higher than the sealing temperature, then a conventional sealing procedure may be employed. Furthermore, a special heating means such as high frequency heating, electric arc heating, laser heating may be applied locally to heat the sphere-like metal, sometimes up to a beginning state of fusion or a temporal fusion state whereon the heated metal is pressed to form a center electrode. In the latter case, a careful pressing should be taken as the viscosity of metal is small or the pressing is preferably done after a suitable viscosity i.e., a suitable lower temperature is achieved for better control of the center electrode formation. However, if the insulator is not heated to such a high temperature, the temperature of the metal will decrease in a short time, and a suitable temperature will be attained without particular difficulties.

The sealable conductive powder material (charging mass) for charging in the center bore encompasses a conductive sealing glass composition and a powdery mixture thereof with a refractory material, wherein at least the former is used for sealing purpose of the terminal rod 4 and other powdery mass to be charged. The conductive sealing glass composition used in the invention is at least sealable at a suitably lower temperature than the melting point of the sphere-like metal as employed, preferably sealable at a softening range of such metal which is usually slightly below the melting point thereof.

The conductive sealing glass composition encompasses a conductive sealing glass composition which comprises 30-70% metallic ingredients and the balance of borosilicate glass frit, the metallic ingredients essentially consisting of one or more selected from the group consisting of Cr, Ni, Fe, Fe—B alloy, Ni—B alloy, Cr, Ag, Co, Mo, W, Fe—Ti alloy, and alloys thereof.

For this purpose, a borosilicate glass frit having following composition by weight percent is employed subject to that the softening point thereof is not exceeding the melting point of the powdery metal employed:

40-80% $SiO_2$, 5-50% $B_2O_3$, 0-23% $Al_2O_3$, 0-10% PbO, 0-10% in total of $Na_2O$, $K_2O$ and/or $Li_2O$, and 0-15% in total of BaO, CaO and/or MgO, preferably, a composition of:

40-70% $SiO_2$, 7-45% $B_2O_3$, 3-20% $Al_2O_3$, 0-8% PbO, 0-8% in total of $Na_2O$, $K_2O$ and/or $Li_2O$, and 0-11% in total of BaO, CaO and/or MgO.

Most preferably, a borosilicate glass frit consisting of 50-70% $SiO_2$, 7-30% $B_2O_3$ and 3-15% $Al_2O_3$ is employed. The softening temperature of such borosilicate glass frit should be not less than approximately 600° C. as the discharge end of the spark plug is usually subjected to a high temperature of 800°-900° C., and an appropriate borosilicate glass having a softening temperature which can withstand the temperature on use should be selected according to the duty. For sealing the vicinity of the center electrode, it is preferred to use a borosilicate glass frit having a softening temperature of not less than 700° C. whereas for the middle portion of the center bore may be the softening temperature thereof not less than 600° C.

The allowable sealing temperature of the conductive sealing composition is practically approximately 800°-1200° C., which, however, varies depending upon the melting point of the metal employed subject to the requirements of the invention. The pressure for terminal rod sealing, i.e. the hot-pressing thereupon is 10-16 $kg/cm^2$ in the prior art. However, a higher pressure of 20-50 $kg/cm^2$ is applied in the hot-pressing for the simultaneous sealing and center electrode-formation.

The resistor material which may optionally be used in the present invention encompasses those which are sealable during the sealing procedure of the sealable conductive powder material (charging mass) by means of hot-pressing. As such a resistor material, a powdery mixture may be applied which, e.g., essentially consists of a 30-70 parts by weight of borosilicate glass frit as aforementioned, 20-40 parts by weight of an aggregate consisting of alumina, zircon, zirconia, mullite and/or clay, 10-30 parts by weight of nitride such as $Si_3N_4$, *AlN, BN or the like, and* 0.5-4 parts by weight of a carbonaceous material, preferably methyl cellulose. The carbonaceous material encompasses cellulose derivatives such as methyl cellulose or carboxyl methyl cellulose, polyhydric alcohol such as glycerin or sorbitol, sacchrides such as sugar, polyvinyl alcohol, arabic gum or the like which will produce resultant carbon or carbon containing substances upon heating.

In the present invention, some suitable known charging masses can be utilized for noise-reduction, i.e., those disclosed in U.S. Pat. No. 4,144,474 Nishio et al of the same assignee can advantageously be used with appropriate modifications. The present invention fascilitates such incorporation of the noise-reduction masses, and the detailed description thereof is herewith incorporated in the present invention by reference to U.S. Patent as above identified.

Accordingly, the spark plug of the present invention can eliminate a precise machining of the center discharge electrode, the requirement for the dimensional accuracy for fitting or adjusting it in the end bore, and a sealing between the center electrode and the insulator (i.e. center bore) need not be considered, because the center electrode is tightly adhered or fixed to the small end bore by way of the pressurized plastic-deformation of the sphere-like metal. Furthermore, according to the preferred embodiment of the invention, the central electrode formation by means of the metal-pressing can be simultaneously be accomplished with the sealing of the charging mass such as the conductive sealing glass composition or the like, which otherwise requires a greater man-hour for the spark plug manufacture.

The Au—Pd alloy can be used as the sphere-like metal, the welding procedure of Au—Pd tip to the Ni rod electrode in the prior art for preparing the Au—Pd tipped center electrode can be eliminated, which is also an advantage of the invention.

Since the center discharge electrode of the invention exhibits a reduced thermal erosion due to its preferred retracted discharge end structure in the small end bore and shows a good thermal conduction to keep off the electrode from a high temperature rise, permitting an application of a relatively low melting point metal such as Ag or alloys thereof and providing a wide-ranging of the spark plug.

In the following a preferred example is disclosed for more detailed illustration, and not limitative purpose.

EXAMPLE 1

The percentages represent a ratio by weight. In a ceramic insulator 3 with a center bore 8 of 4.7 mm diameter, a small end bore 2 of 1.5 mm diameter was formed at the bottom end the center bore 8 having 1.5 mm width as shown in FIG. 1. A spherical metal (3.0 mm diameter) having a composition of 60% Ag, 30% Au and 10% Pd was inserted in a center bore 8 and set on a small end bore 2 at a bottom of the former. Thereupon, 0.3 g of a conductive powder mixture consisting of a 30% borosilicate glass frit (65% $SiO_2$, 30% $B_2O$; and 5% $Al_2O_3$), 10% $Al_2O_3$ powder and 60% Cu powder through 20 mesh was filled and precompacted, whereafter a 0.4 g resistor material (mixture powder) consisting of 40 parts of the same borosilicate glass frit as abovementioned, 30 parts powder zirconia, 30 parts powder $Si_3N_4$, and a 2 parts carbonaceous material (methyl cellulose) was charged thereupon and precompacted. Then 0.3 g conductive borosilicate glass composition consisting of 50% Cu powder and the same borosilicate glass frit as aforementioned was charged and precompacted, whereafter a terminal rod 4 of 4.0 mm diameter threaded at its bottom (insertion) end was inserted thereupon. The resultant assembly was heated to 800°-1100° C. in a continuously operating furnace, then the removed assembly was hot-pressed upon its terminal rod head by an axial pressure of 20-50 kg/cm$^2$, thus allowing the spherical metal to be fixed in the small end bore and simultaneously the charged mass pressedly to be sealed.

The resultant spark plug 9 is shown in FIG. 1 which contains in an order beginning from the discharge end (bottom in FIG. 1) the center electrode 1, conductive sealing material 5', resistor material layer 7, conductive sealing material 5 and the terminal rod 4.

The resistor materials which may advantageously be used also in the present invention encompasses a self-sealable glassy resistor composition disclosed in U.S. Pat. No. 4,006,106 M. Yoshida et al, and a resistor composition disclosed in U.S. Pat. No. 4,173,731 S. Takagi et al, the description of both U.S. patents being incorporated in the present invention by the reference thereto. These resistor materials can occupy the bottom portion of the spark plug having the sphere-like metal center electrode of the present invention.

We claim:

1. A spark plug comprising a refractory insulator with a center bore having a bottom end provided with a small end bore being smaller than the remainder of the center bore and a discharge center electrode fixed to said small end bore by means of pressing a metallic sphere having a higher melting point than a sealing temperature of a conductive sealing glass in said small end bore.

2. A spark plug defined in claim 1, wherein the metallic sphere essentially consists of one selected from the group consisting of Au, Ag, Au—Ag alloy, alloys of each foregoing metal with Pd, Ni, Cr or Ni—Cr, alloys of each of Au—Pd, Ag—Pd and Au—Ag—Pd with Ni, Cr or Ni—Cr, and Ag—Pt alloy.

3. A spark plug defined in claim 1, wherein the metallic sphere has a melting point approximately ranging 950°-1500° C.

4. A spark plug defined in claim 1, wherein said small end bore is tapered with an increasing diameter towards the inside of said center bore.

5. A spark plug defined in claim 4, wherein said small end bore is tapered longitudinally at least over a partial length of the small end bore.

6. A spark plug defined in claim 1 or 4, wherein the small end bore is beveled or tapered at its outer discharge end with an increasing diameter outwardly to the discharge area.

7. A spark plug defined in claim 4, wherein the inside tapering of the small end bore is an extended end portion of a tapered end formed at the bottom of the center bore.

8. A spark plug defined in claim 1, wherein the discharge center electrode is formed with its discharge end retracted in the small end bore.

9. A spark plug defined in claim 1, wherein the discharge center electrode is fixed to the small end bore at or below a softening temperature range thereof.

10. A spark plug defined in claim 1, wherein a portion of said metal sphere remains overlapping the small end bore and extending into the center bore.

11. A process for manufacturing a spark plug which comprises a step of forming a small end bore at a bottom end of a refractory insulator with a center bore, said small end bore being smaller than the remainder of the center bore, and a step of hot-pressing a metallic sphere, having a higher melting point than a sealing temperature of a conductive sealing glass, in the small end bore outwardly from the center bore thereby forming and making a discharge center electrode tightly fixed to the small end bore.

12. A process defined in claim 11, wherein the metallic sphere essentially consists of one selected from the group consisting of Au, Ag, Au—Ag alloy, alloys of each foregoing metal with Pd, Ni, Cr or Ni—Cr, alloys of each of Au—Pd, Ag—Pd and Au—Ag—Pd with Ni, Cr or Ni—Cr, and Ag—Pt alloy.

13. A process defined in claim 11 wherein the metallic sphere has a melting point of approximately 950°-1500° C.

14. A process for manufacturing a spark plug which comprises:

a. forming a small end bore at a bottom end of a refractory insulator with a center bore, said small end bore being smaller than the remainder of the center bore, b. setting a metallic sphere on the small end bore on the interior side of the center bore, c. charging the center bore with a sealable conductive powder material upon said metallic sphere, d. heating the sealable conductive powder material and the metal, and e. hot-pressing the sealable conductive powder material and the metal thereby to seal the sealable conductive powder material and the metal thereby to seal the sealable conductive powder material and to form a discharge center electrode.

15. A process defined in claim 14, wherein said metallic sphere is deformable within a temperature range of a sealing temperature for the sealable conductive powder material.

16. A process defined in claim 14 or 15, wherein the metallic sphere has a melting point approximately ranging 950°-1200° C.

17. A process defined in claim 14, wherein the sealable conductive powder material is a conductive sealing glass and/or a powdery mixture thereof with a refractory material.

18. A process defined in claim 14 which optionally comprises an additional step of charging the center bore with powdery resistor material after the step c and thereafter again a step c' of charging the center bore with a sealable conductive powder material thereupon superposed.

19. A process defined in claim 18, wherein said powdery resistor material is a sealable carbonaceous powdery resistor material or selfsealable powdery resistor material.

20. A process defined in claim 14 or 18, wherein said hot-pressing step e is carried out by means of an axial pressure application onto a terminal rod inserted in the center bore after the step c or c', respectively.

21. A process defined in claim 17, wherein the borosilicate glass frit is essentially consisting of 50-70% $SiO_2$, 7-30% $B_2O_3$ and 3-15% $Al_2O_3$ by weight.

22. A process defined in claim 17, wherein said powdery mixture consists of 5-20% by weight of refractory material and the balance of the conductive sealing glass.

23. A process defined in claim 22, wherein the refractory material is one or more selected from the group consisting of alumina, zircon, zirconia and mullite.

24. A process defined in claim 18, wherein the sealable conductive powder material is a conductive sealing glass for the steps c and c' provided that the step e is carried out by means of an axial pressure application onto a terminal rod inserted in the center bore after the step c'.

25. A process defined in claim 17, 18 or 24, wherein the conductive sealing glass essentially consisting of 30-70% metallic ingredients and the balance of borosilicate glass frit, the metallic ingredients essentially consisting of one or more selected from the group consisting of Cu, Ni, Fe, Fe—B alloy, Ni—B alloy, Cr, Ag, Co, Mo, W, Fe—Ti alloy, Ni—Cr alloy and alloys thereof, and the borosilicate glass frit having a following composition:

40-80% $SiO_2$, 5-50% $B_2O_3$, 0-23% $Al_2O_3$, 0-10% PbO, 0-10% in total of $Na_2O$, $K_2O$ and/or $Li_2O$, and 0-15% in total of BaO, CaO and/or MgO.

* * * * *

UNITED STATES PATENT AND TRADEMARK OFFICE

CERTIFICATE OF CORRECTION

PATENT NO. : 4,393,324

DATED : July 12, 1983

INVENTOR(S) : NISHIO et al.

It is certified that error appears in the above-identified patent and that said Letters Patent is hereby corrected as shown below:

Front page, correct the name of the assignee: change "NGK Spark Plug Co." to --NGK Spark Plug Co., Ltd.--;

Front page, correct the name of attorney: change "Segner" to --Wegner--; and

Column 10, line 20 (claim 25), change "18" to --22--

Signed and Sealed this

*Thirteenth* Day of *December 1983*

[SEAL]

*Attest:*

GERALD J. MOSSINGHOFF

*Attesting Officer*

*Commissioner of Patents and Trademarks*